US009956763B2

(12) United States Patent
Anderson et al.

(10) Patent No.: US 9,956,763 B2
(45) Date of Patent: May 1, 2018

(54) EVALUATING PRINT HEAD NOZZLE CONDITION

(71) Applicant: HEWLETT-PACKARD DEVELOPMENT COMPANY, L.P., Houston, TX (US)

(72) Inventors: Daryl E Anderson, Corvallis, OR (US); Eric T Martin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/304,750

(22) PCT Filed: Apr. 23, 2014

(86) PCT No.: PCT/US2014/035080
§ 371 (c)(1),
(2) Date: Oct. 17, 2016

(87) PCT Pub. No.: WO2015/163861
PCT Pub. Date: Oct. 29, 2015

(65) Prior Publication Data

US 2017/0043572 A1 Feb. 16, 2017

(51) Int. Cl.
*B41J 2/045* (2006.01)
*B41J 2/165* (2006.01)
(Continued)

(52) U.S. Cl.
CPC ..... *B41J 2/0451* (2013.01); *B41J 2/0458* (2013.01); *B41J 2/04541* (2013.01);
(Continued)

(58) Field of Classification Search
CPC .... B41J 2/0451; B41J 2/14153; B41J 2/0458; B41J 2/04541; B41J 2/04555; B41J 2/16579; B41J 2/2142; B41J 2002/14354
See application file for complete search history.

(56) References Cited

U.S. PATENT DOCUMENTS 5,550,569 A 8/1996 Wright
6,109,732 A 8/2000 Wen
(Continued)

FOREIGN PATENT DOCUMENTS

CN 103079828 5/2013
WO WO2013158099 10/2013
(Continued)

OTHER PUBLICATIONS

U.S. Appl. No. 15/114,938, Non-Final Rejection dated Mar. 2, 2017, pp. 1-5 and attachments.
(Continued)

*Primary Examiner* — Yaovi M Ameh
(74) *Attorney, Agent, or Firm* — HP Inc. Patent Department

(57) ABSTRACT

The present subject matter relates to evaluating print head nozzle condition of a plurality of nozzle columns. Each of the plurality of nozzle columns comprises a set of nozzles. A plurality of drive bubble detect modules are activated, by a timing circuit coupled to each of the plurality of nozzle columns upon occurrence of at least a first predetermined time instant and a second predetermined time instant. For each of the plurality of nozzle columns, test results for a nozzle of the nozzle column are registered by the corresponding drive bubble detect module. Test results obtained based on impedances measured across a nozzle associated with the nozzle column corresponding to a drive bubble detect module are registered by the drive bubble detect module at the first predetermined time instant and the second predetermined time instant. The print head nozzle condition of the nozzle is evaluated based on the test results.

18 Claims, 8 Drawing Sheets

(51) Int. Cl.
*B41J 2/21* (2006.01)
*B41J 2/14* (2006.01)

(52) U.S. Cl.
CPC ..... *B41J 2/04555* (2013.01); *B41J 2/14153* (2013.01); *B41J 2/16579* (2013.01); *B41J 2/2142* (2013.01); *B41J 2002/14354* (2013.01)

(56) References Cited

U.S. PATENT DOCUMENTS

| | | | | |
|---|---|---|---|---|
| 6,183,056 | B1 | 2/2001 | Corrigan et al. | |
| 6,476,928 | B1 | 11/2002 | Barbour et al. | |
| 7,287,832 | B2 | 10/2007 | Hayasaki | |
| 8,336,981 | B2 | 12/2012 | Chen et al. | |
| 8,556,364 | B2 | 10/2013 | Hoisington et al. | |
| 2004/0223027 | A1* | 11/2004 | Shinkawa | B41J 2/0451 347/23 |
| 2005/0231562 | A1 | 10/2005 | Torgerson | |
| 2009/0058914 | A1 | 3/2009 | Kim et al. | |
| 2010/0049077 | A1 | 2/2010 | Sadleir | |
| 2012/0081471 | A1 | 4/2012 | Liao | |
| 2013/0278656 | A1* | 10/2013 | Govyadinov | B41J 2/2142 347/9 |
| 2013/0278657 | A1 | 10/2013 | Martin et al. | |
| 2017/0001433 | A1 | 1/2017 | Anderson | |
| 2017/0106646 | A1 | 4/2017 | Anderson | |

FOREIGN PATENT DOCUMENTS

| | | |
|---|---|---|
| WO | WO-2013158103 | 10/2013 |
| WO | WO-2013158105 | 10/2013 |
| WO | WO-2015116072 | 8/2015 |

OTHER PUBLICATIONS

U.S. Appl. No. 15/114,938, Non-Final Rejection dated Jul. 18, 2017, pp. 1-7 and attachments.

U.S. Appl. No. 15/114,938, Non-Final Rejection dated Oct. 23, 2017, pp. 1-10 and attachments.

U.S. Appl. No. 15/307,865, Non-Final Rejection dated Jul. 20, 2017, pp. 1-9 and attachments.

* cited by examiner

EVALUATING PRINT HEAD NOZZLE CONDITION

BACKGROUND

Inkjet printing involves releasing ink droplets onto a print medium, such as paper. In order to accurately produce the details of the printed content, nozzles in a print head accurately and selectively release multiple ink drops. Based on movement of the print head relative to the printing medium, the entire content is printed through the release of such multiple ink drops. Over a period of time and use, the nozzles of the print head may develop defects and hence would not operate in a desired manner. As a result, print quality may get affected. Therefore, a print system may perform periodic checks to determine whether one or more nozzles are working properly. In case a nozzle is defective, a different nozzle may be used in order to achieve a better print quality.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the figures to reference like features and components.

DETAILED DESCRIPTION

Figure 1A:
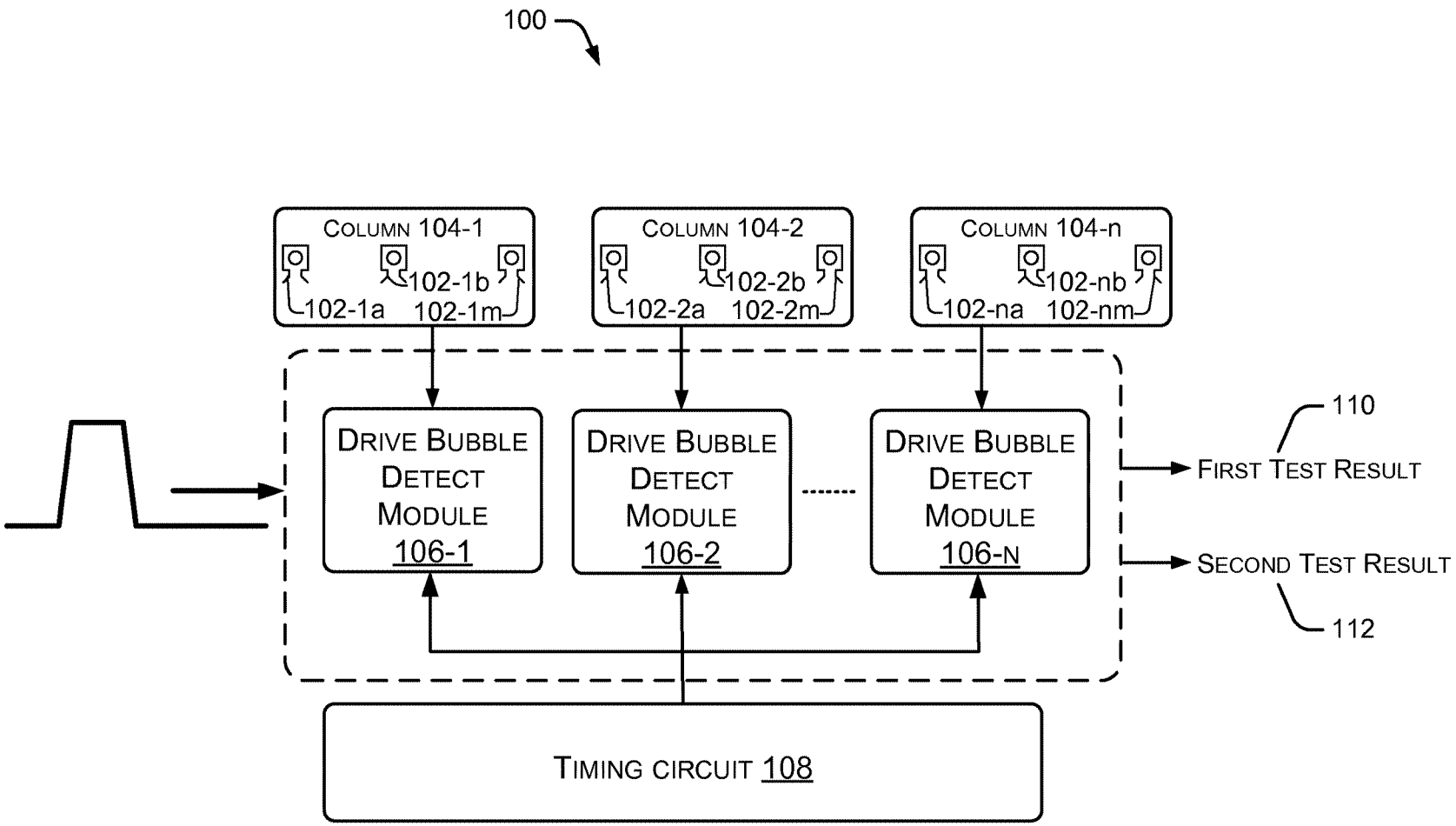
FIG. 1*a* illustrates a system for evaluating print head nozzle conditions for a plurality of nozzle columns, according to an example of the present subject matter.

Approaches for determining print head nozzle conditions for a plurality of nozzle columns of an inkjet printing system are described. Modern inkjet printing systems print content on a print medium, such as paper. The printing is implemented by directing multiple drops of ink onto the print medium. The ink is directed through multiple print head nozzles, interchangeably referred to as nozzles, positioned onto a print head of the printing system. Typically, the nozzles are arranged into the plurality of nozzle columns or arrays on the print head, with each nozzle column having a set of nozzles. The nozzles are arranged into the columns such that properly sequenced ejection of ink from the nozzles causes characters or other images to be printed upon the print medium, as the print head and the print medium are moved relative to each other. For example, the print head may move laterally with the print medium being conveyed through a conveying mechanism.

It should be noted that the ink nozzle is subjected to various cycles of heating, drive bubble formations, drive bubble collapses, and replenishments of the ink supply. Over a period of time and depending on other operating conditions, the nozzle within the print head may get blocked. For example, particulate matter within the ink may cause the nozzle to get clogged. In other cases, small volume of ink may get solidified over the course of the printer's operation resulting in the clogging of the nozzle. Further, failure of circuit coupled to the thermal resistor may prevent heating of the ink chamber, which will also prevent proper ink drop ejection. As a result, the formation and release of the ink drop may get affected. Since the ink drop has to form and be released at precise instances of time, any such blockages in the nozzle are likely to have an impact on the print quality.

In cases where such a situation is detected, appropriate measures, such as servicing or nozzle replacements, may be performed much in advance without affecting the print quality of the printer under consideration. The condition of the nozzle may be monitored and determined through a detection circuit. Such detection circuit involves a sensor for detecting presence or absence of a drive bubble. The sensor may be provided within a print head nozzle chamber of the nozzle. For example, any ink in contact with the sensor will offer less electrical impedance to the current provided through the sensor. Similarly, at the time when the drive bubble is present, air within the drive bubble will offer high impedance as compared to the impedance offered by the ink volume.

Depending on the measurements of impedance and the corresponding voltage or current variations due to the presence (or absence) of ink within the ink chamber, it may be determined whether the drive bubble has formed or not. In this manner, an indication whether the nozzle is operating in the desired manner, may be obtained. The obtained indications or results may be communicated to circuits on the print head or in the printer system for processing so as to determine the condition of the nozzle. For instance, the indications or results may be communicated to the processing unit of the printer. In such cases, communicating such signals off-chip to the processing unit or to other components of the printer may require bandwidth. Furthermore, communicating the sensor signals off-chip may introduce issues, such as timing issues and/or electrical noise, which might affect the accuracy of such determinations. The processing of the sensor signals may also be done on-chip but such an implementation may require complex circuit and might be intensive in terms of both space on the print head and in terms of print head cost.

Systems and methods for evaluating print head nozzle conditions of a plurality of nozzle columns are described. In one example, method for determining the print head nozzle condition is described. The method, as per the present subject matter, is further implemented through a minimal circuit implemented onto the print head, for determining the print head nozzle condition. As per an example of the present subject matter, the minimal circuit is implemented to evaluate the print head nozzle condition for each of a plurality of nozzles provided on the print head.

As mentioned previously, the nozzles are arranged into the plurality of nozzle columns on the print head, with each nozzle column having a set of nozzles. The minimal circuit evaluates the print head nozzle condition, for each nozzle, based on impedances associated with the nozzle measured at predetermined time instants. Continuing with the present example, the minimal circuit includes a timing circuit and a plurality of drive bubble detect circuits for evaluating the print head nozzle condition. The minimal circuit is implemented such that all the nozzle columns are coupled to a single timing circuit, while a separate drive bubble detect circuit is provided for each column.

Each of the plurality of drive bubble detect circuits is coupled to a corresponding nozzle column to evaluate the print head nozzle condition for each nozzle associated with the nozzle column. The timing circuit is coupled to each drive bubble detect circuit to activate the drive bubble detect circuit at the predetermined time instants for evaluating the print head nozzle condition of the corresponding nozzle column.

In one example, for each nozzle column, a nozzle is activated to eject the ink drops based on a pulse, referred to as a firing pulse. Once the firing pulse is received, the heating element is activated which forms the drive bubble within the ink chamber. The timing circuit may subsequently activate the drive bubble detect modules for each of the nozzle columns upon occurrence of the first predetermined time instant and the second predetermined time instant.

Upon activation, the drive bubble detect modules may measure the impedance variations across the activated nozzle associated with their corresponding nozzle column. The drive bubble detect modules may subsequently register test results for the nozzle associated with the corresponding nozzle column. In one example, the test results may be obtained based on impedances measured across the nozzle at the first predetermined time instant and the second predetermined time instant. The print head nozzle condition of the nozzle may be subsequently evaluated based on the test results.

No further processing is done for processing the test results. As a result, the test results need not be communicated, say, to a processor of the printer, to determine the print head nozzle condition. The determination of the nozzle condition is thus done on-chip using the minimal circuit, as opposed to off-chip. In this manner, use of resources to communicate and process signals indicating print head nozzle conditions may be avoided, thereby reducing the overheads on the processing unit of the printer. Using a single timing circuit further facilitates in avoiding issues related to electrical noise interference and also reduces the demand on bandwidth for communicating nozzle condition information to different components of the printer.

Further, sharing a single timing circuit among the nozzle columns facilitates in reduction of space utilized for implement the minimal circuit for each nozzle column on the print head. Furthermore, since the minimal circuit for determining the condition of the print head nozzle is implemented using a plurality of logical-based components, the resulting circuit is less complex.

The above methods and systems are further described with reference to FIGS. 1 to 6. It should be noted that the description and figures merely illustrate the principles of the present subject matter. It is thus understood that various arrangements may be devised that, although not explicitly described or shown herein, embody the principles of the present subject matter. Moreover, all statements herein reciting principles, aspects, and embodiments of the present subject matter, as well as specific examples thereof, are intended to encompass equivalents thereof.

FIG. 1*a* illustrates a system 100 for evaluating print head nozzle conditions for a plurality of nozzle columns, according to an example of the present subject matter. The system 100 as described is implemented within circuit of a print head (not shown in this figure) of a printer (not shown in this figure). The system 100 includes a plurality of print head nozzles 102, hereinafter referred to as nozzles 102. In one example, the nozzles 102 are arranged into a plurality of nozzle columns 104-1, 104-2, . . . , 104-*n* on the print head. The plurality of nozzle columns 104-1, 104-2, . . . , 104-*n* are hereinafter collectively referred to as nozzle columns 104 and individually referred to as nozzle column 104. As should be noted, each nozzle column 104 may have a set of nozzles 102 from among the plurality of nozzles 102. For instance, the nozzle column 104-1 may include a set of nozzles 102-1*a*, 102-1*b*, . . . , 102-1*m*, while the nozzle column 104-2 may include a set of nozzles 102-2*a*, 102-2*b*, . . . , 102-2*m*. The nozzle column 104-*n* may include a set of nozzles 102-*na*, 102-*nb*, . . . , 102-*nm*.

The system 100 further includes a plurality of drive bubble detect modules 106-1, 106-2, . . . , 106-*n* to evaluate the print head nozzle condition. The drive bubble detect modules 106-1, 106-2, . . . , 106-*n*, are, hereinafter collectively referred to as drive bubble detect modules 106 and individually referred to as drive bubble detect module 106. In one example, each drive bubble detect module 106 is coupled to a corresponding nozzle column 104 and its respective nozzles 102. For instance, the drive bubble detect module 106-1 may be coupled to the nozzle column 104-1 and its respective nozzles 102-1*a*-102-1*n*, while the drive bubble detect module 106-2 may be coupled to the nozzle column 104-2 and its respective nozzles 102-2*a*-102-2*n*. The drive bubble detect module 106 evaluates the print head nozzle condition, for each respective nozzle 102, based on impedances associated with the nozzle 102, measured at predetermined time instants.

The system 100 further includes a timing circuit 108 coupled to the drive bubble detect modules 106 for activating the drive bubble detect modules 106 at the predetermined time instants. In one example, the timing circuit 108 may activate the drive bubble detect modules 106 to determine the impedances associated with the nozzles 102 at a first predetermined time instant and a second predetermined time instant. The drive bubble detect modules 106 may subsequently use the impedances for evaluating the print head nozzle condition for the nozzles 102 for which the impedances are measured.

As will be explained subsequently, the drive bubble detect modules 106 determine the variations in impedances which occur due to the formation or collapse of a drive bubble, at the predetermined time instants. In one example, the drive bubble detect modules 106 determine the variations in impedances through a sensor (not shown in this figure) associated with the nozzles 102. Each sensor measures the impedance associated with the corresponding nozzle 102. The impedance is measured by passing a current through the ink volume present in the nozzle 102. Since the ink is a conducting medium, the ink provides less impedance to a current. Once the drive bubble is formed, the impedance offered would be high. Consequently, the impedance associated with the nozzle 102 would be low and high, respectively. Based on the measured impedances, each of the drive bubble detect modules 106 provides output test results, namely a first test result 110 and a second test result 112 for their corresponding nozzles. In one example, the drive bubble detect modules 106 provide the output test results as logical signals, say, an ink_out test result as the first test result 110 and an ink_in test result as the second test result 112.

While determining the impedances associated with the nozzles 102, the drive bubble detect modules 106 may compare the measured impedance with respect to a threshold impedance. In one example, the timing circuit 108 may activate the drive bubble detect modules 106 so that the measured impedance is captured or registered at the occurrence of the first predefined time instant and the second predetermined time instant. The drive bubble detect modules 106 may include memory elements, such as latches (not shown in this figure) for registering and providing the outcome. For registering, the measured impedance is stored in the latches.

Figure 1B:
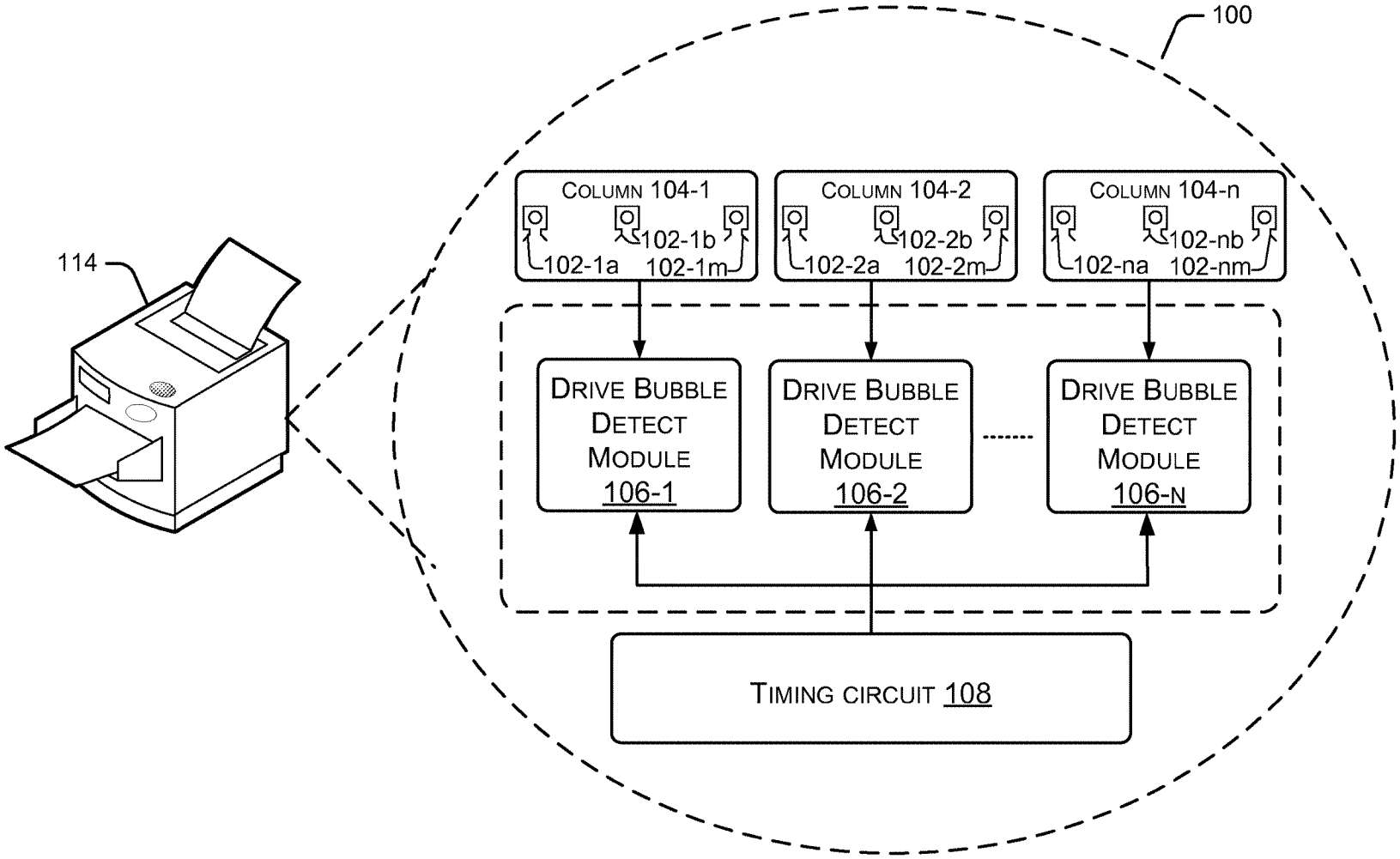
FIG. 1*b* illustrates a printer incorporating the system for evaluating the print head nozzle condition of the plurality of nozzle columns, according to an example of the present subject matter.

FIG. 1*b* illustrates a printer 114 implementing a system for evaluating the print head nozzle condition of the nozzle columns 104, according to an example of the present subject matter. As illustrated, the system for evaluating the condition of the nozzles 102 of the nozzle columns 104, such as the system 100, is implemented within the printer 114. In another example, the drive bubble detect module 106 and the timing circuit 108 are implemented onto a print head of the printer 114.

Figure 1C:
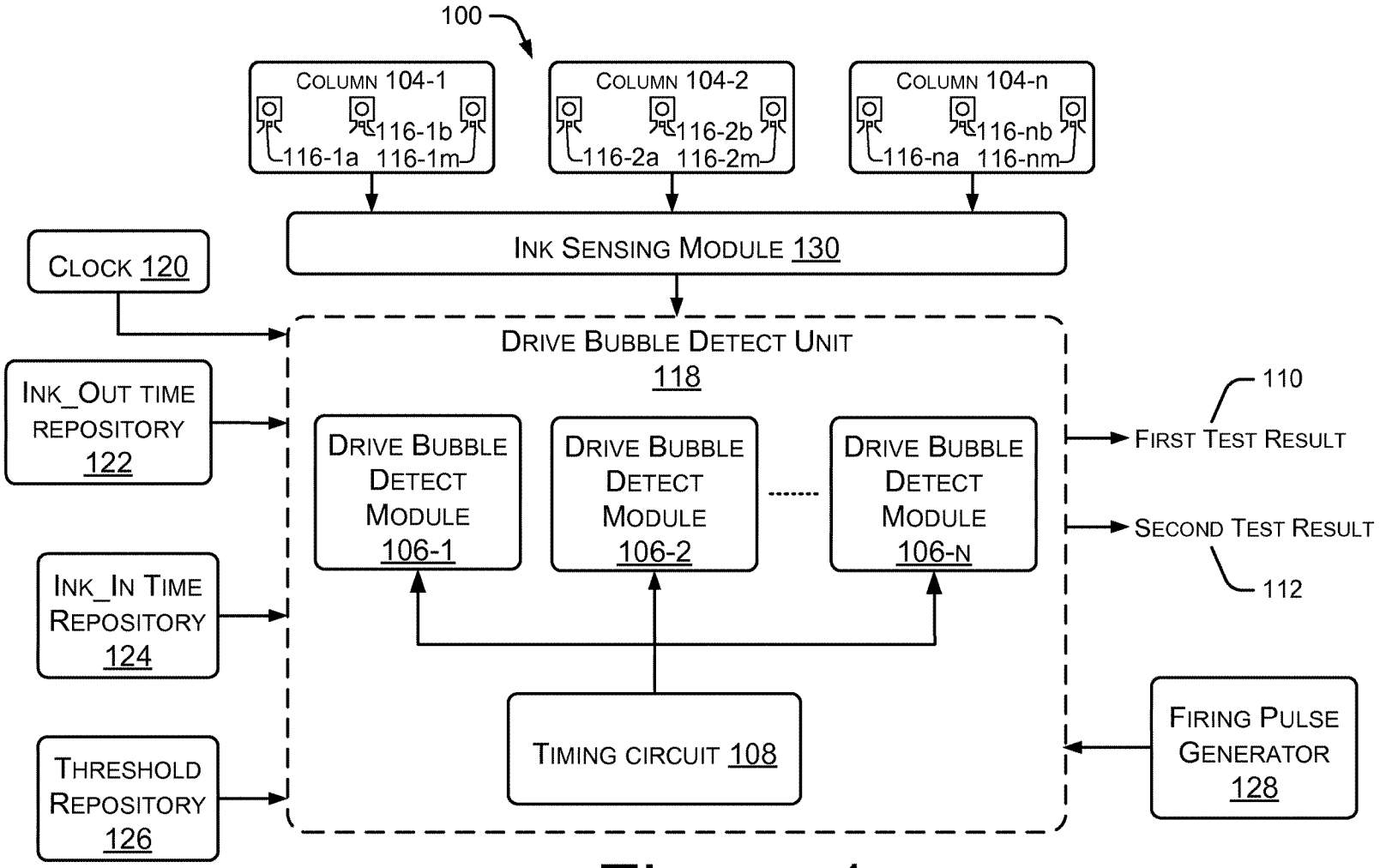
FIG. 1*c* illustrates another system for evaluating the print head nozzle condition of the plurality of nozzle columns, according to yet another example of the present subject matter.

FIG. 1*c* illustrates a system 100 for evaluating the print head nozzle condition of the nozzle columns 104, according to another example of the present subject matter. The system 100 as described is implemented within circuit of a print head of a printer, such as the printer 114. The system 100 includes the nozzle columns 104 having the nozzles 102 coupled to the corresponding drive bubble detect modules 106. Each of the plurality of nozzles 102 further includes a sensor 116. For instance, the nozzles 102-1*a*, 102-1*b*, 102-1*m*, 102-2*a*, 102-2*b*, 102-2*m*, 102-*na*, 102-*nb*, and 102-*nm* may include a sensor 116-1*a*, 116-1*b*, 116-1*m*, 116-2*a*, 116-2*b*, 116-2*m*, 116-*na*, 116-*nb*, and 116-*nm*, respectively. The sensors 116-1*a*, 116-1*b*, . . . , 116-1*m*; 116-2*a*, 116-2*b*, . . . , 116-2*m*; and 116-*na*, 116-*nb*, . . . , 116-*nm* are hereinafter collectively referred to sensors 116 and individually referred to as sensor 116.

In one example, the sensor 116 is configured to measure the impedance associated with the nozzle 102. The system 100 further includes a drive bubble detect unit 118, a clock 120, ink_out time repository 122, ink_in time repository 124, threshold repository 126, a firing pulse generator 128, and an ink sensing module 130. Each of the above mentioned modules are coupled to the drive bubble detect unit 118. The drive bubble detect unit 118 further includes the drive bubble detect modules 106 and the timing circuit 108 coupled to the drive bubble detect modules 106. Although not explicitly represented, each of the modules may be further connected to each other, without deviating from the scope of the present subject matter.

The drive bubble detect module 106 based on the input received from one or more of the modules as illustrated, provides the first test result 110 and the second test result 112 for evaluation of the print head nozzle condition. For the sake of brevity, and not as a limitation, the evaluation of the print head nozzle condition is described with respect to a single nozzle. The same may, however, be performed for all nozzles and for all nozzle columns In operation, a printing process may be initiated through a firing pulse. On receiving the firing pulse, a heating element (not shown) within the nozzle 102 may heat the ink, thereby resulting in the formation of the drive bubble. Prior to the forming of the drive bubble, the ink being in contact with the sensor 116 will provide low impedance. When the drive bubble has formed, the ink ceases to be in contact with the sensor 116, and thus the impedance measured would be consequently high.

As previously described, the drive bubble detect modules 106 determine the impedance at predetermined time instants, for example, the first predetermined time instant and the second predetermined time instant. In one example, the time instants are determined after a predefined time has elapsed from the occurrence of the firing pulse and are managed and controlled by the timing circuit 108. While measuring the impedance associated with the nozzles 102, the drive bubble detect modules 106 may compare the measured impedance with respect to a threshold impedance, at the first predetermined time instant. The drive bubble detect modules 106 may include a first set of memory elements, such as latches for registering and providing the outcome.

For a properly functioning nozzle, a drive bubble would have formed by the first predetermined time instant. Consequently, while prior to the firing event, the impedance measured by the sensor 116 was low, the impedance measured associated with nozzle 102 should be high at the first time instant. In case the drive bubble detect module 106 determines that the impedance variation has not occurred by the first predetermined time instant, it may be concluded that the drive bubble either did not form properly or was weak, i.e., collapsed prematurely. On the other hand, if the drive bubble detect module 106 determines that the impedance measured is high, the nozzle 102 would be considered as healthy and functioning properly. The determination of the drive bubble detect module 106 may be represented as the first test result 110. Since the first test result 110 corresponds to a state where the ink flows out of the print head nozzle 102, the first test result 110 may be interchangeably referred to as an ink_out test result.

The drive bubble detect module 106 further may also compare the measured impedance with respect to the threshold impedance, at the second predetermined time instant. In one example, the timing circuit 108 may activate the drive bubble detect module 106 so that the measured impedance is captured or registered at the occurrence of the second predefined time instant. The drive bubble detect module 106 may include a second set of memory element, such as latches for registering and providing the outcome.

For a properly functioning nozzle, a drive bubble would have collapsed after the second predetermined time instant. Consequently, the impedance measured would vary from high to low, as the ink is replenished within the ink chamber. It should be noted that in such a case, ink flows into a nozzle chamber of the nozzle 102. In case the drive bubble detect module 106 determines that the impedance variation has occurred by the second predetermined time instant, it may be concluded that the drive bubble did collapse, and that the ink supply within the print head nozzle was replenished, in a timely manner. If however, the drive bubble detect module 106 determines that the variation occurs beyond the second predetermined time instant, it may be concluded that the nozzle 102 is either blocked or that a stray drive bubble is present within the nozzle 102, and provides the result of such a determination as the second test result 112, interchangeably referred to an ink_in test result.

In order to evaluate the condition or health of the nozzle 102, both the first test result 110 and the second test result 112 are used. For example, when both the ink_out test result and the ink_in test result are indicating that the drive bubble formed and collapsed in a timely manner, would the print head nozzle 102 be considered as healthy. In another example, the first test result 110 and the second test result 112 may be communicated to a processing unit of the printer 114 for further implementing one or more remedial action, in response to the first test result 110 and the second test result 112. The first test result 110 and the second test result 112, in one example, may be in a binary form.

Figure 2:
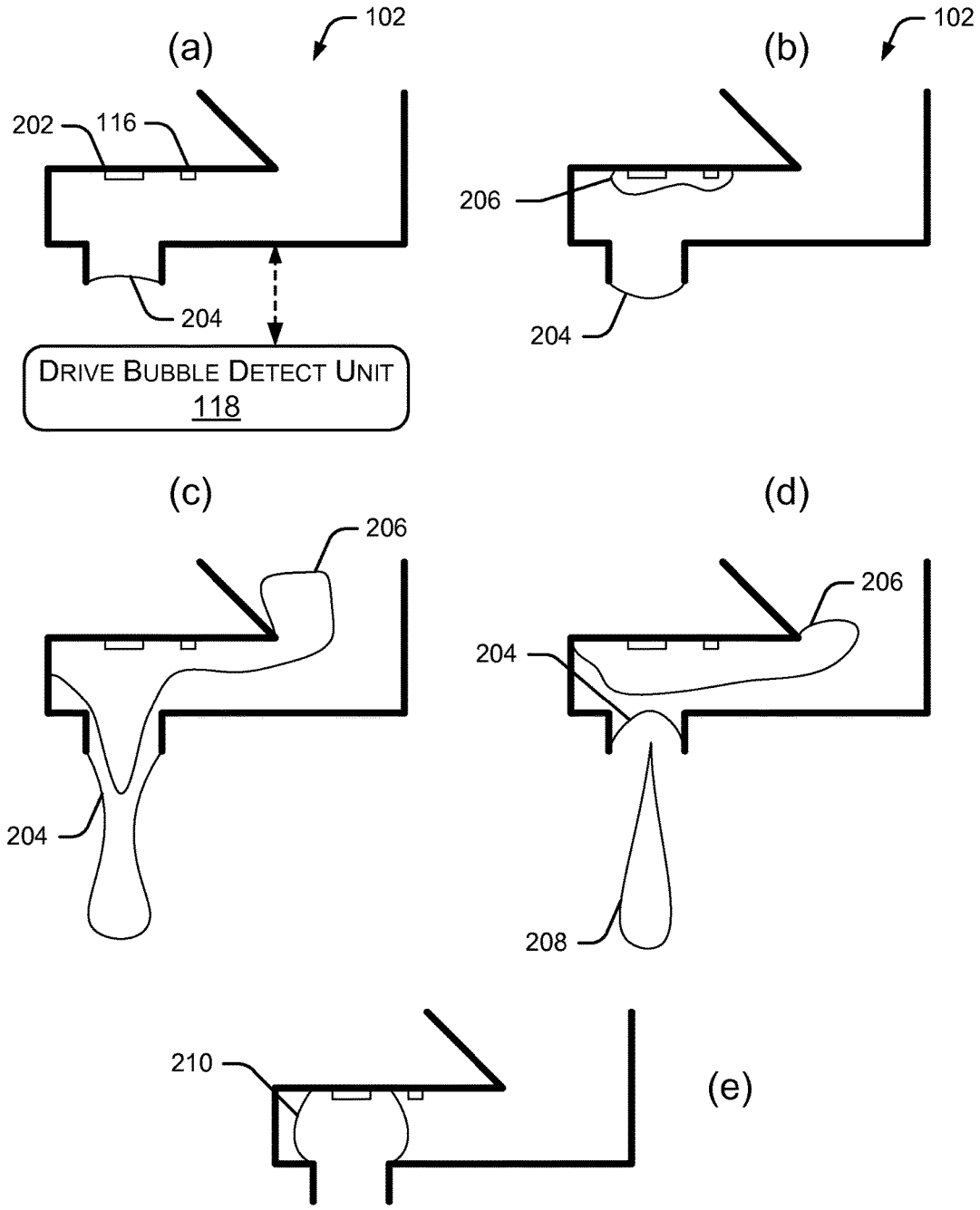
FIG. 2(*a*)-(*e*) provides cross-sectional illustrations of a print head with a print head nozzle in various stages of a drive bubble formation, according to an example of the present subject matter.

The working of the system 100 is further explained in conjunction with FIG. 2. FIG. 2 provides an illustration of the nozzle 102 depicting the formation and the collapse of the drive bubble. As per the present example, the nozzle 102 includes a heating element 202 and the sensor 116. Through the action of the heating element 202, the sensor 116 may monitor the variations in the impedance associated with the nozzle 102 due to the formation of a drive bubble 206. Further, as illustrated the nozzle 102 may be coupled to the drive bubble detect unit 118. Further, for the sake of brevity, and not as limitation, the drive bubble detect unit 118 has been illustrated for FIG. 2(*a*) and not for all Figure. The drive bubble detect unit 118, however, will be similarly coupled to the nozzle 102 at all stages of formation and the collapse of the drive bubble.

Continuing with the present example, the nozzle 102 prepares for ejecting ink drop(s) based on a fire pulse received from the firing pulse generator 128. Prior to receiving the firing pulse, the ink is retained within the nozzle 102 due to capillary action, with an ink level 204 contained within the nozzle 102. On receiving the firing pulse, the heating element 202 initiates heating of the ink in the nozzle 102. As the temperature of the ink in the proximity of the heating element 202 increases, the ink may evaporate and form the drive bubble 206. As the heating continues, the drive bubble 206 expands and forces the ink level 204 to extend beyond the nozzle 102 (as depicted through FIGS. 2(*a*)-(*c*), as per one example of the present subject matter).

As also mentioned previously, the ink within the nozzle 102 would offer certain electrical impedance to a specific electrical current. Typically, mediums, such as ink are good conductors of electric current. Consequently, the electrical impedance offered by the ink within the nozzle 102 would also be less. As the nozzle 102 prepares for ejecting ink drops, the sensor 116 may pass a finite electrical current through the ink within the nozzle 102. The electrical impedance associated with the nozzle 102 may be measured through the sensor 116. The following description has been presented with respect to impedance associated with the nozzle 102, without deviating from the scope of the present subject matter.

In one example, as the drive bubble 206 forms due to the action of the heating element 202, the ink in the proximity of the sensor 116 may lose contact with the sensor 116. As the drive bubble 206 forms, the sensor 116 may get completely surrounded by the drive bubble 206. At this stage, since the sensor 116 is not in contact with the ink, the impedance, and therefore the impedance measured by the sensor 116 would be correspondingly high. The impedance measured by the sensor 116 would register a constant value during the time interval for which the sensor 116 is not in contact with the ink. As the drive bubble 206 expands further, the physical forces arising out of the capillary action would no longer be able to hold the ink level 204. An ink drop 208 is formed which then separates from the nozzle 102. The separated ink drop 208 is thus ejected towards the print medium, as depicted through FIG. 2(*d*). Once the ink drop 208 is ejected, ink in the nozzle 102 is replenished by the incoming ink flow from a reservoir (not shown in the figure). At this stage the heating element 202 also ceases to heat the ink within the nozzle 102. As the ink is replenished, the drive bubble 206 collapses to result into a space 210, thereby restoring the contact with the sensor 116, as is depicted in FIG. 2(*e*).

The sensor 116 measures the variations in impedance that occur during the course of the drive bubble 206 formation and collapse. The impedance associated with the nozzle 102 will remain low at instants when ink is present and the drive bubble 206 is not present, and will be high when the drive bubble 206 is present. While the drive bubble 206 is forming and when the drive bubble 206 has collapsed, the impedance measured by the ink sensing module 130 would vary. As per an example of the present subject matter, the variations in the drop across the nozzle 102 are measured by the ink sensing module 130 at specific time instants. The specific time instants are measured after a predefined time has elapsed after the occurrence of a firing pulse. The specific time instants may be representative of the time instants at which the ink would be present and not present in the nozzle 102.

In one example, the specific time instants may include the first predetermined time instant and the second predetermined time instant. The first predetermined time instant may correspond to a point in time when the drive bubble 206 has formed, i.e., when the ink has been or is in the process of being dispensed from the nozzle 102. The first predetermined time instant, as per an example, is referred to as an ink_out time. Furthermore, as the drive bubble 206 expands and the ink drop is dispensed from the nozzle 102, the drive bubble 206 will collapse thereby restoring contact with the sensor 116. As a result, the impedance will vary, i.e., will decrease over a period of time. The drive bubble detect module 106 determines the impedance at the second predetermined time instant. Since during the present stage, the ink flow is incident into the nozzle 102, the second predetermined time instant is referred to as the ink_in time. The ink_in time and the ink_out time are stored within the ink_out time repository 122 and the ink_in time repository 124, as per one example.

Continuing with the present example, the impedance associated with the nozzle 102 is measured after the firing pulse has been initiated. In one example, the impedance is measured with respect to the falling edge of the firing pulse. At the instance when the falling edge of the firing pulse occurs, the ink sensing module 130 measures the impedance associated with the nozzle 102. In one example, when the falling edge of the firing pulse occurs, the drive bubble 206 may have formed, or may be in the process of being formed. At this stage, the ink within the nozzle 102 is not in contact with the sensor 116. As a result, the measured impedance would be correspondingly high. The drive bubble detect module 106 subsequently obtains the ink_out time from the ink_out time repository 122. As mentioned previously, the ink_out time specifies the time at which the drive bubble 206 would have formed for a properly functioning nozzle 102.

On obtaining the ink_out time from the ink_out time repository 122, the drive bubble detect module 106 obtains the impedance associated with the nozzle 102 from the ink sensing module 130. The drive bubble detect module 106 then determines and compares the impedance associated with the nozzle 102 at the instant prescribed by the ink_out time, with a threshold impedance. Depending on whether the impedance is high, the drive bubble detect module 106 may determine whether the nozzle 102 is functioning in the desired manner. For example, the impedance associated with the nozzle 102 being less than the threshold would indicate that the drive bubble 206 either formed late or did not form at all, which in turn would indicate that the nozzle 102 is blocked. The ink_out time is determined with respect to the instance when the falling edge of the firing pulse occurs. In one example, the time elapsed from the instance of the falling edge of the firing pulse, may be measured through a clocked signal provided by the clock 120. In another example, the drive bubble detect module 106 provides an output indicating the determination for the ink_out time as the first test result 110, i.e., the ink_out test result.

The drive bubble 206 formed would continue to expand till an ink drop 208 is formed and ejected from the nozzle 102. When the ink drop 208 is ejected, the drive bubble 206 would collapse and the ink would again come in contact with the sensor 116. As a result, the impedance associated with the nozzle 102 would also drop. The drive bubble detect module 106 determines whether the variation in the impedance occurs, i.e., the impedance associated with the nozzle 102 is lower than the threshold at the second predefined time instant. In one example, the drive bubble detect module 106 determines whether the impedance variation, occurring due to the collapsing of the drive bubble 206, occurs by the time instant prescribed by the ink_in time. The ink_in time may be obtained from the ink_in time repository 124.

Based on the impedance determined at the ink_in time, the drive bubble detect module 106 determines whether the nozzle 102 is working in the desired manner. For example, if the impedance associated with the nozzle 102 does not change, i.e., remains high, it may be concluded that the drive bubble 206 has persisted within the nozzle 102 for a longer time period. This typically occurs when an ink drop, say the ink drop 208 takes a longer time to form particularly due to a blocked nozzle. It may also be the case, that a stray bubble has perhaps been formed within the nozzle 102.

If however the drive bubble detect module 106 determines that the impedance associated with the nozzle 102 is less than the voltage at the ink_in time, it may be concluded that the nozzle 102 is working in the desired manner. In one example, the drive bubble detect module 106 provides an output indicating the determination for the ink_in time as the second test result 112, i.e., the ink_in test result. In one example, both the ink_out test result and the ink_in test result are considered for determining whether the nozzle 102 is functioning in the proper manner. In another example, the impedance associated with the nozzle 102 may be determined with respect to a threshold, provided by the threshold repository 126.

In yet another example, the timing circuit 108 may be employed for measuring impedances at the ink_out time instant and the ink_in time instant. In such a case, the timing circuit 108 may measure the time that has elapsed from the occurrence of the firing pulse based on a clocked signal from the clock 120. Once the time as prescribed by the ink_out time has been reached, the timing circuit 108 may activate the drive bubble detect modules 106 to determine a logical output based on the impedance measured at the ink_out time instant. The logical output may be determined based on the comparison between the impedance measured and a threshold.

The logical output may be registered within the drive bubble detect module 106 as the first test result 110. In another example, the drive bubble detect module 106 may further include memory element, such as latches which stores the first test result 110. Similarly, the timing circuit 108 may also monitor the time using the clocked signal from clock 120. As the time instant prescribed by the ink_in time occurs, the timing circuit 108 may further activate the drive bubble detect module 106 to determine another logical output and store the same. In an example, another logical output may be stored as the second test result 112.

Figure 3:
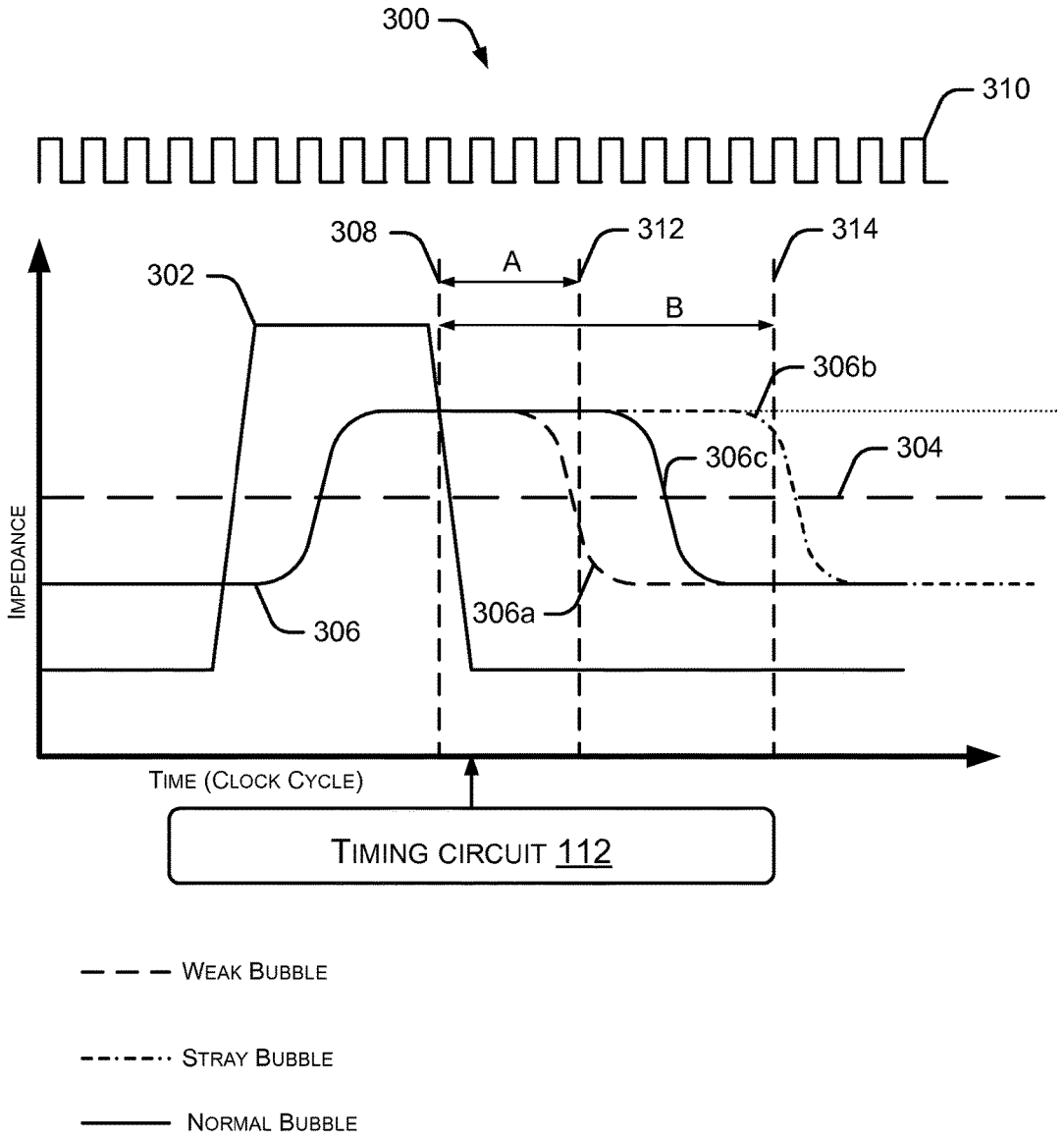
FIG. 3 graphically illustrates impedance variations across a print head nozzle in various stages of drive bubble formation, according to an example of the present subject matter.

FIG. 3 provides a graphical representation 300 depicting the variations in the impedance measured by the sensor associated with nozzle 102, as per one example of the present subject matter. Furthermore, the graph 300 is provided for sake of illustration and should not be construed as a limitation. Other graphs depicting such variations would also be within the scope of the present subject matter. Further, the same graphical representation may be true for all the nozzles 102. The graph 300 depicts a firing pulse 302 and threshold impedance 304. The threshold impedance 304 may be provided by a source, such as threshold repository 126. The variations in the impedance occurring at the nozzle 102 are indicated by the graph 306. In operation, the printing process is initiated by the firing pulse 302. Prior to the firing pulse 302, the ink is present in the nozzle 102. Since the ink offers low impedance to a current provided by the sensor 116, the impedance 306 associated with the nozzle 102 is also low. As the process initiates a drive bubble, such as the drive bubble 206, forms thereby increasing the impedance 306 associated with the nozzle 102.

The drive bubble detect module 106, on the falling edge of the firing pulse 302, determines and compares the impedance 306 at instants as prescribed by the ink_out time and ink_in time with the threshold impedance 304. The instants as prescribed by the ink_out time and ink_in time are provided by the timing circuit 108, as illustrated in the FIG. 3. In one example, the drive bubble detect module 106 starts monitoring the impedance 306 at the instance 308. The drive bubble detect module 106 measures the impedance 306 with respect to the threshold impedance 304, at the ink_out time. The time period as prescribed by the instant ink_out time is depicted by instant 312. In one example, determining the duration (as depicted by A) whether the ink_out time has elapsed may be measured through the clocked signal 310 provided by the clock 120. The impedance 306 is measured by the ink sensing module 130 and provided to the drive bubble detect module 106.

The drive bubble detect module 106 compares the impedance 306 with the threshold impedance 304 to determine whether the nozzle 102 is working in a desired manner. For example, if the impedance 306 does not vary with respect to the threshold impedance 304 and remains high (as depicted by graph 306*c*), the drive bubble detect module 106 may provide the first test result 110 as positive indicating that the drive bubble 206 is being or has formed properly. If however, at the ink_out time, the impedance 306 is below or less than the threshold impedance 304 (as depicted by graph 306*a*), the drive bubble detect module 106 may determine that the drive bubble 206 formed was weak or not properly formed. The first test result 110 may be provided as a binary value, i.e., either as a 0 or 1. For example, a first test result 110 of 0 may be indicative of a formation of a weak drive bubble 206. On the other hand, a first test result 110 as 1, may indicate that the drive bubble 206 formed was proper.

The drive bubble detect module 106 further compares the impedance 306 measured by the ink sensing module 130, with the threshold impedance at a second predetermined time instant. In one example, the drive bubble detect module 106 compares the impedance 306 at the time instant ink_in time, with the threshold impedance 304. The ink_in time, as illustrated in FIG. 3 (the duration which is shown as B) is depicted as the instant 314. At the ink_in time, the drive bubble detect module 106 determines whether the impedance 306 falls below the threshold impedance 304. As described in detail in the preceding paragraphs, the impedance 306 would decrease when the drive bubble 206 collapses and the ink is again brought in contact with the sensor 116. If the decrease in the impedance 306 occurs by the ink_in time, the drive bubble detect module 106 may determine that the drive bubble 206 collapsed at the desired time, and that the nozzle 102 is working in a proper manner. It may also be the case that the drive bubble detect module 106 determines that the decrease in the impedance 306 occurred after the ink_in time (as depicted by graph 306*b*). Such a scenario would typically arise when the drive bubble 206 did not collapse as planned and persisted for a longer period of time. In such a case, the drive bubble detect module 106 may attribute the same to a blocked nozzle condition.

The determination of whether the nozzle 102 is blocked or not, may be provided by the drive bubble detect module 106 as the second test result 112. The second test result 112 may in turn be represented through binary values. For example, the second test result 112 of 0 may indicate that the nozzle 102 is blocked. On the other hand, the second test result 112 of 1 could be used to indicate that the nozzle 102 is not blocked. As per an example, previously discussed, the first test result 110 and the second test result 112 may be collectively used for determining whether the nozzle 102 is functioning in the desired manner. For example, the drive bubble detect module 106 may provide the first test result 110 and the second test result 112 as a two bit output. The two bit output may be processed on the print head on which the nozzle 102 is implemented, or may be communicated to the processing unit of the printer (say the printer 114) for representing the condition of the nozzle 102. Depending on the condition of the nozzle 102, appropriate remedial action, such as servicing or replacing the print head, may be initiated.

The above examples determine print head nozzle condition based on determining as to how the impedance associated with the print head nozzle varies at predefined time instants as monitored by the timing circuit 108. The time instants are measured from the falling edge of the firing pulse. However, the time instants could also be measured from the leading edge of the firing pulse, without deviating from the scope of the present subject matter.

Figure 4:
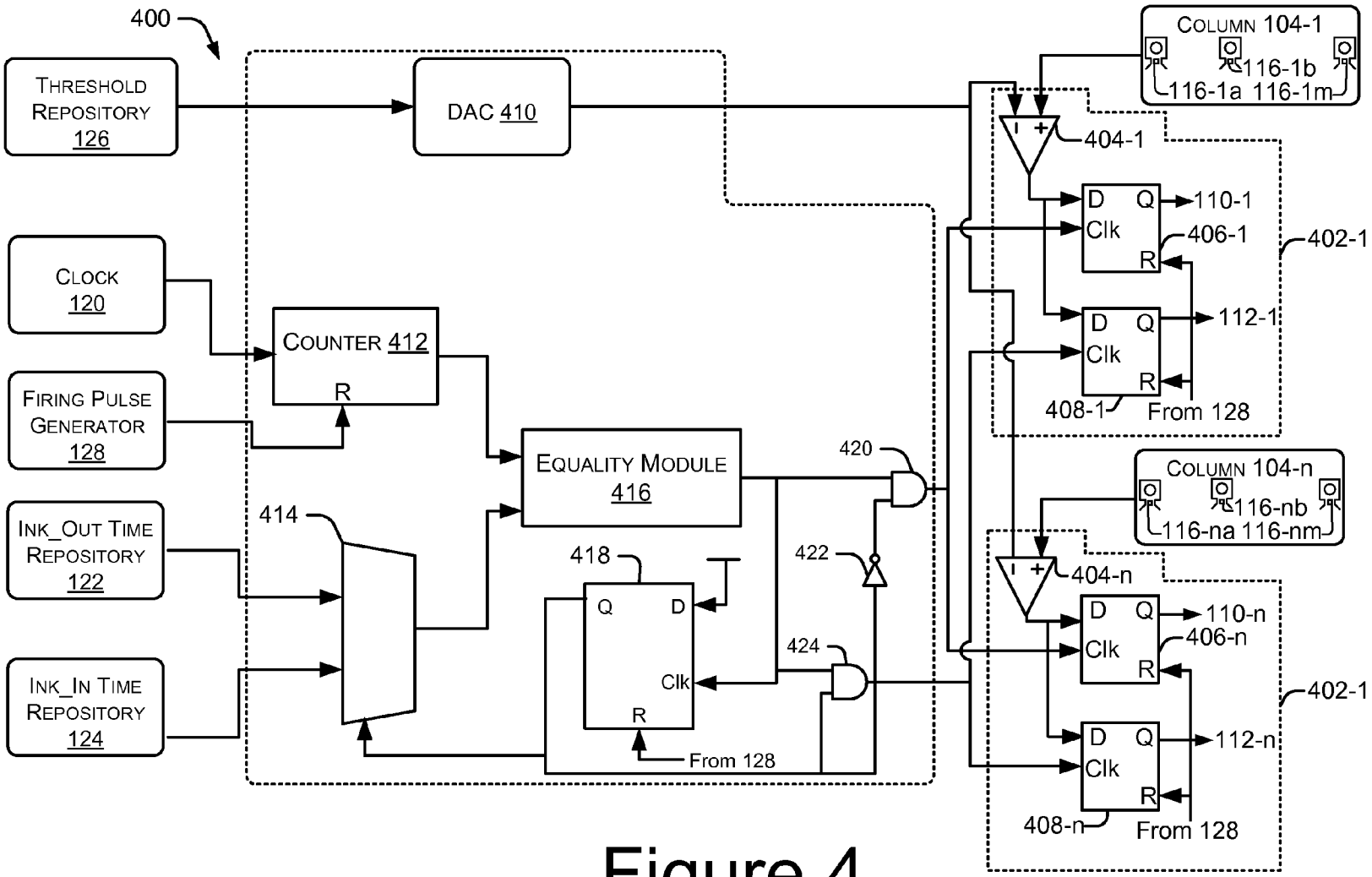
FIG. 4 illustrates a logical circuit implemented on print head die for evaluating the print head nozzle condition of the plurality of nozzle columns, according to an example of the present subject matter.

FIG. 4 represents, according to an example of the present subject matter, a circuit minimal circuit 400 for determining print head nozzle conditions, implemented onto the print die. In one example, the drive bubble detect circuit 402 implements the functionality of the drive bubble detect unit 118. The circuit minimal circuit 400 may include a plurality of drive bubble detect circuits 402-1, . . . , 402-*n*, hereinafter collectively referred to as drive bubble detect circuits 402 and individually referred to as drive bubble detect circuit 402. The circuit minimal circuit 400 may further include the timing circuit 108 coupled to each of the drive bubble detect circuits 402. In one example, the drive bubble detect circuit 402 implements the functionality of the drive bubble detect module 106. Further, although the clock 120, the ink_out time repository 122, the ink_in time repository 124, the threshold repository 126, and the firing pulse generator 128 have been shown outside the minimal circuit 400, in one example, the minimal circuit 400 may include the clock 120, the ink_out time repository 122, the ink_in time repository 124, the threshold repository 126, and the firing pulse generator 128.

As illustrated in FIG. 4, each drive bubble detect circuit 402 is coupled to the corresponding nozzle column 104 for evaluating the print head nozzle condition of the set of nozzles 102 associated with nozzle column 104. In one example, the drive bubble detect circuits 402 may be coupled to the corresponding nozzle columns 104 through the ink sensing module 130. Further, each drive bubble detect circuit 402 may be coupled to the sensor 116 of each nozzle 102 of the corresponding nozzle column 104. For instance, the drive bubble detect circuit 402-1 may be coupled to the nozzle column 104-1 and its associated set of nozzles 102-1*a*, 102-1*b*, . . . , 102-1*m*, while the drive bubble detect circuit 402-*n* may be coupled to the nozzle column 104-*n* and its associated set of nozzles 102-*na*, 102-*nb*, . . . , 102-*nm*.

Each drive bubble detect circuit 402, i.e., the drive bubble detect module 106 may include a comparator 404 and memory elements, such as a first latch referred to as an ink_out latch 406 and a second latch referred to as the ink_in latch 408. For instance, the drive bubble detect circuit 402-1, i.e., the drive bubble detect module 106-1 may include a comparator 404-1, an ink_out latch 406-1, and an ink_in latch 408-1. The drive bubble detect circuit 402-*n*, i.e., the drive bubble detect module 106-*n* may include a comparator 404-*n*, an ink_out latch 406-*n*, and an ink_in latch 408-*n*. The comparators 404-1, . . . , 404-*n* are hereinafter collectively referred to as comparators 404 and individually referred to as comparator 404. The ink_out latches 406-1, . . . , 406-*n* are hereinafter collectively referred to as ink_out latches 406 and individually referred to as ink_out latch 406. The ink_in latch 408-1, . . . , 408-*n* are hereinafter collectively referred to as ink_in latch 408 and individually referred to ink_in latch 408.

The positive terminal of the comparator 404 is coupled to the nozzle column 104 through the ink sensing module 130. In one example, the ink sensing module 130 provides an analog signal based on the impedance or the impedance measured across the nozzle 102 as a result of presence or absence of ink within the nozzle 102. The other terminal of the comparator 404 is coupled to a Digital-to-Analog Convertor (DAC) 410. The DAC 410 receives the threshold impedance signal, such as the threshold impedance 304, from the threshold repository 126. The DAC 410 converts the digital threshold impedance signal 304 to analog, and provides it as an input to the negative terminal of the comparator 404.

In one example, any signal applied to the positive terminal of a comparator, such as the comparator 404, would be the basis for performing the comparison. For example, the output of the comparator 404 would be high, when the input from the DAC 410 (and consequently the threshold repository 126) is less than the input received from the ink sensing module 130. Similarly, the comparator 404 would provide a low output when the input provided by the DAC 410 is greater than the input received from the ink sensing module 130.

The output of the comparator 404 is provided to the ink_out latch 406 and the ink_in latch 408. As illustrated, the ink_out latch 406 and the ink_in latch 408 are implemented using a D-type flip flop. However, other types of latches or flip flops may also be used without deviating from the scope of the present subject matter.

Continuing with the other components of the circuit 400, the ink_out latch 406 and the ink_in latch 408 receive timing signals through a combination of a counter 412, a multiplexer 414, an equality module 416, and a test select latch 418. The combination of such components is further coupled to the ink_out latch 406 and the ink_in latch 408, respectively, through a series of AND and NOT gates. In one example, the test select latch 418 is also implemented using a D-type flip flop. Further, the DAC 410, the counter 412, the multiplexer 414, the equality module 416, the test select latch 418, and the series of AND and NOT gates is provided in the timing circuit 108. Further, other types of logic may also be used for controlling/triggering the flip-flops and/or latches.

Each of the ink_out latch 406, the ink_in latch 408, the counter 412, the equality module 416, and the test select latch 418 also includes a reset latch R. The reset latch of each of the aforementioned components is connected to the firing pulse generator 116. The counter 412 is further coupled to the clock 120 which provides a clock signal, such as the clocked signal 310. The output of the counter 412 is provided as an input to the equality module 416. The other terminal of the equality module 416 is coupled to the multiplexer 414. The multiplexer 414 in turn receives input from the ink_in time repository 124 and the ink_out time repository 122. Returning to the equality module 416, its output is provided as a clocked input to the test select latch 418, and the ink_out latch 406 and the ink_in latch 408. In the present example, the input of the test select latch 418 is maintained at a constant high.

In one example, the circuit 400 is further coupled to a single current source, via a pass FET (not shown in the Figure) to the sensor 116 within the nozzle 102. Such an example may be implemented in succession for a plurality of print head nozzles which are being evaluated. In another example, a second pass FET (not shown in the Figure) may be used for connecting the sensors 116 to the positive terminal of the corresponding comparator 404, thereby allowing a single circuit to be used for a set of nozzles, such as the nozzle 102-1*a*, . . . , 102-1*m* associated with the nozzle column 104-1 corresponding to the comparator 404-1. In yet another example, the comparator 404 and the DAC 410 may also be employed for performing other functionalities, such as temperature control when not be used for evaluating condition of the nozzle 102.

In operation, the output of the comparator 404 will provide a digital output as low when the ink is present within the nozzle 102. As mentioned previously with ink being an electrical conductor, the impedance offered by the ink and consequently the impedance, such as impedance 306, across the nozzle 102 will be low. As a result, the output of the comparator 404 will be logical low, or 0.

Similarly, when the ink is not present in the nozzle 102, i.e., when a drive bubble, such as drive bubble 206, has formed, the impedance offered (and the voltage) will be high. The measured impedance will also be higher as compared to the threshold impedance 304. As a result, in such circumstances the output of the comparator 404 will also be logical high, or 1.

For evaluating the condition of the nozzle 102, firing pulse, such as the firing pulse 302, is initiated. The firing pulse 302 includes a rising edge and a falling edge. For the duration when the firing pulse 302 is rising, the ink_out latch 406, the ink_in latch 408, the counter 412, and the test select latch 418 are all reset. Once the edge of the firing pulse 302 falls, i.e., the firing pulse 302 goes low, it results in termination of the resetting of the ink_out latch 406, the ink_in latch 408, the counter 412, and the test select latch 418. At this stage, the counter 412 begins counting the clock cycles of clocked signal provided by the clock 106. The counter 412 uses the clocked signal, such as the clocked signal 310, for monitoring the time that has elapsed from the instance the firing pulse 302 started going low.

As the evaluation of the nozzle 102 is initiated, the test select latch 418 provides a select signal to the multiplexer 414 for selecting the ink_out time repository 122. As mentioned previously, at the time when the firing pulse 302 went low, the resetting of the test select latch 418 was terminated. At this stage, the output of the test select latch 418 is 0, which selects the ink_out time repository 122. In the present example, the multiplexer 414 allows selecting the ink_out time repository 122 when the test select latch 418 outputs a logical low, and selects the ink_in time repository 124 when the test select latch 418 outputs a logical high.

With this, the multiplexer 414 selects the ink_out time repository 122 and provides the same to the equality module 416. The equality module 416 continuously compares the output of the counter 412 with the value provided by the ink_out time repository 122. The equality module 416 provides a high output or a 1, whenever the input to the equality module 416 matches. In the present case, the output of the equality module 416 would be 1, when the counts by the counter 412 matches with the value obtained from the ink_out time repository 122. At this stage, both the input terminals to gate 420 are high, which allows the ink_out latch 406 to latch onto and register, i.e., store the output of the comparator 404. For instance, the ink_out latch 406-1 may latch onto and register the output of the comparator 404-1, while the ink_out latch 406-*n* may latch onto and register the output of the comparator 404-*n*.

Further, when the equality module 416 provides a high output to the test select latch 418, the test select latch 418 is set and provides a select signal for the ink_in time repository 124. Once selected, the equality module 416 continuously compares the output of the counter 412 with the value provided by the ink_in time repository 124. The equality module 416 provides a high output or a 1, when the counts by the counter 412 matches with the value obtained from the ink_in time repository 124. At this stage, since the output of the test select latch 418 is high, the ink_out latch 406 is not selected due to the NOT gate 422. However, both the input terminals to gate 424 are high, which allows the ink_in latch 408 to latch onto and register, i.e., store the output of the comparator 404. For instance, the ink_in latch 408-1 may latch onto and register the output of the comparator 404-1, while the ink_in latch 408-*n* may latch onto and register the output of the comparator 404-*n*.

A print head nozzle, such as the nozzle 102, would be considered to be functioning properly if the output of the first test result 110 of the ink_out latch 406 is high and if the output of the second test result 112 of the ink_in latch 408 is low. For instance, the nozzle 116-1*a* would be considered to be functioning properly if the first test result 110-1, i.e., the ink_out test result of the ink_out latch 406-1 is high and if the second test result 112-1, i.e., the ink_in test result of the ink_in latch 408-1 is low. The nozzle 102-1*n* would be considered to be functioning properly if the first test result 110-*n*, i.e., the ink_out test result of the ink_out latch 406-*n* is high and if the second test result 112-*n*, i.e., the ink_in test result of the ink_in latch 408-*n* is low. The first test result 110-1, . . . , 110-*n* are hereinafter collectively referred to as first test results 110 and individually referred to as first test result 110. The second test result 112-1, . . . , 112-*n* are hereinafter collectively referred to as second test results 112 and individually referred to second test result 112.

At this point the values of the two test result latches, i.e., first test result 110 and the second test result 112 may be used by the printhead, or may be communicated to the printer 114 either as two bits, or combined into one bit representing a healthy, or not healthy nozzle.

Table 1 provided below, provides a chart based on which the print head nozzle condition of the nozzles, such as the nozzle 102, is assessed according to an example of the present subject matter. The chart provides various issues which could be present with a nozzle, such as the nozzle 102, depending on the first test result 110 and the second test result 112.

TABLE 1

| ink_out test | ink_in test | Issue |
|---|---|---|
| 0 | 0 | Weak or no bubble |
| 0 | 1 | Unexpected |
| 1 | 0 | Normal |
| 1 | 1 | Nozzle blockage or ink inlet blockage |

Depending on the issue determined based on Table 1 above, appropriate remedial action may be initiated.

It should be noted that the above example is illustrative and should not be construed as a limitation. Other examples are also implementable each of which would be within the scope of the present subject matter. For instance, instead of determining the time durations with respect to the falling edge of the firing pulse, the leading edge may also be considered. In such a case, the counter 412 may start counting the clock cycles with respect to the rising edge of the firing pulse. Other examples may further include extending the circuit by adding additional time registers, test result latches, and an extra test state latch, so as to perform compares for more number of time durations, without deviating from the scope of the present subject matter.

Figure 5:
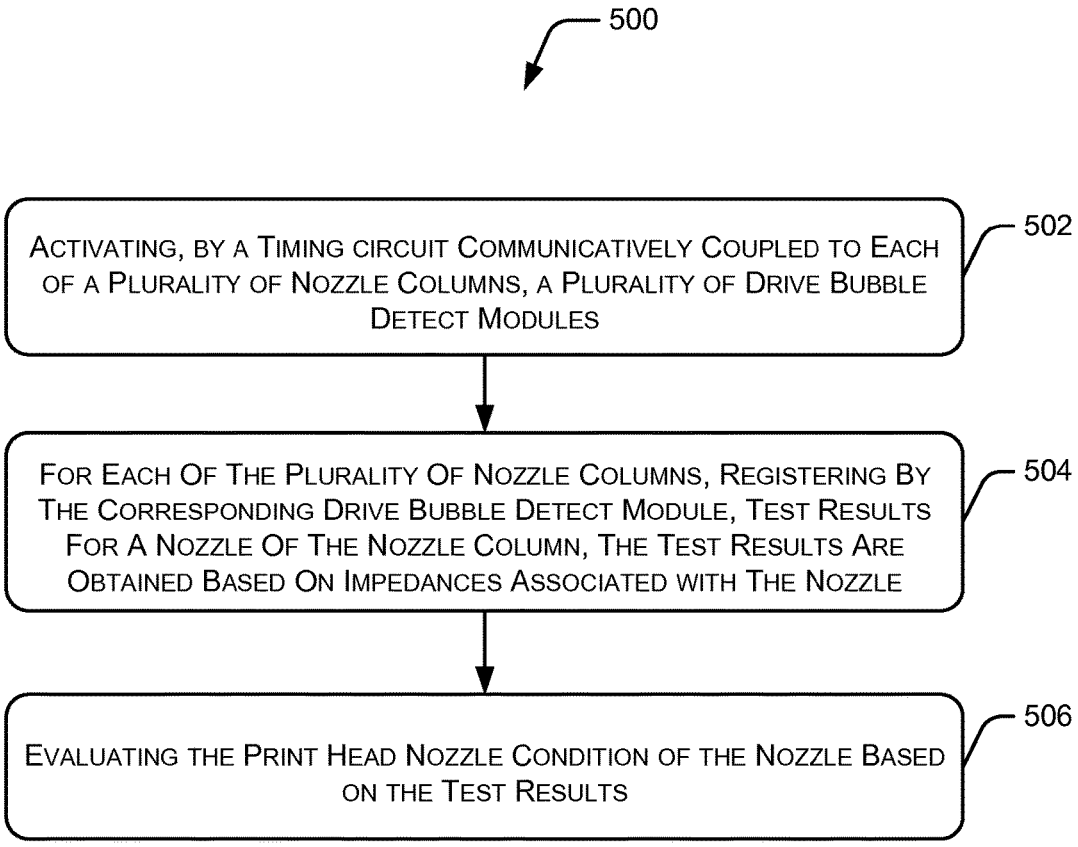
FIG. 5 illustrates a method of evaluating the print head nozzle condition of the plurality of nozzle columns, according to an example of the present subject matter.

FIG. 5 illustrates a method 500 for evaluating the print head nozzle condition of a plurality of nozzle columns, according to an example of the present subject matter. The order in which the method 500 is described is not intended to be construed as a limitation, and any number of the described method blocks may be combined in any order to implement the method 500 or an alternative method.

Further, although the method 500 for evaluating the print head nozzle condition of a plurality of nozzle columns may be implemented in a variety of logical circuit; in an example described in FIG. 5, the method 500 is explained in context of the aforementioned system 100.

Referring to FIG. 5, at block 502 a plurality of drive bubble detect modules are activated by a timing circuit coupled to each of a plurality of nozzle columns. Each of the plurality of nozzle columns comprises a set of nozzles. Further, each of the plurality of drive bubble detect modules is coupled to a corresponding nozzle column from among the plurality of nozzle columns. For example, the timing circuit 108 may activate the plurality of drive bubble detect modules 106 coupled to the corresponding nozzle columns 104 having the set of nozzles 102. Further, the drive bubble detect modules are activated upon occurrence of at least a first predetermined time instant and a second predetermined time instant. In such a case, the timing circuit 108 may measure the time that has elapsed from the occurrence of the firing pulse based on a clocked signal from clock 120. Once the time instants as prescribed by the first predetermined time and the second predetermined time have reached, the timing circuit 108 may activate the drive bubble detect module 106 at these instances.

At block 504, test results obtained based on impedances associated with a nozzle of each of the nozzle columns are registered by corresponding drive bubble detect modules. For example, as the timing circuit 108 activates the drive bubble detect modules 106 at the first predetermined time instant and the second predetermined time instant, the drive bubble detect modules 106 may determine a logical output for nozzle 102 of their corresponding nozzle columns 104. The logical output may be registered by the drive bubble detect module 106 as the test results 110, 112.

At block 506, the print head nozzle condition of the print head nozzle is evaluated based on the test results. For example, based on the impedance measured by the sensor 116 at the first predetermined time instant, i.e., the ink_out time, and the second predetermined time instant, i.e., the ink_in time, the drive bubble detect module 106 determines the ink_out test result 110 and the ink_in test result 112 for each of the nozzle columns. Based on the test results 110 and 112, the condition of the nozzles 102 may be evaluated.

Figure 6:
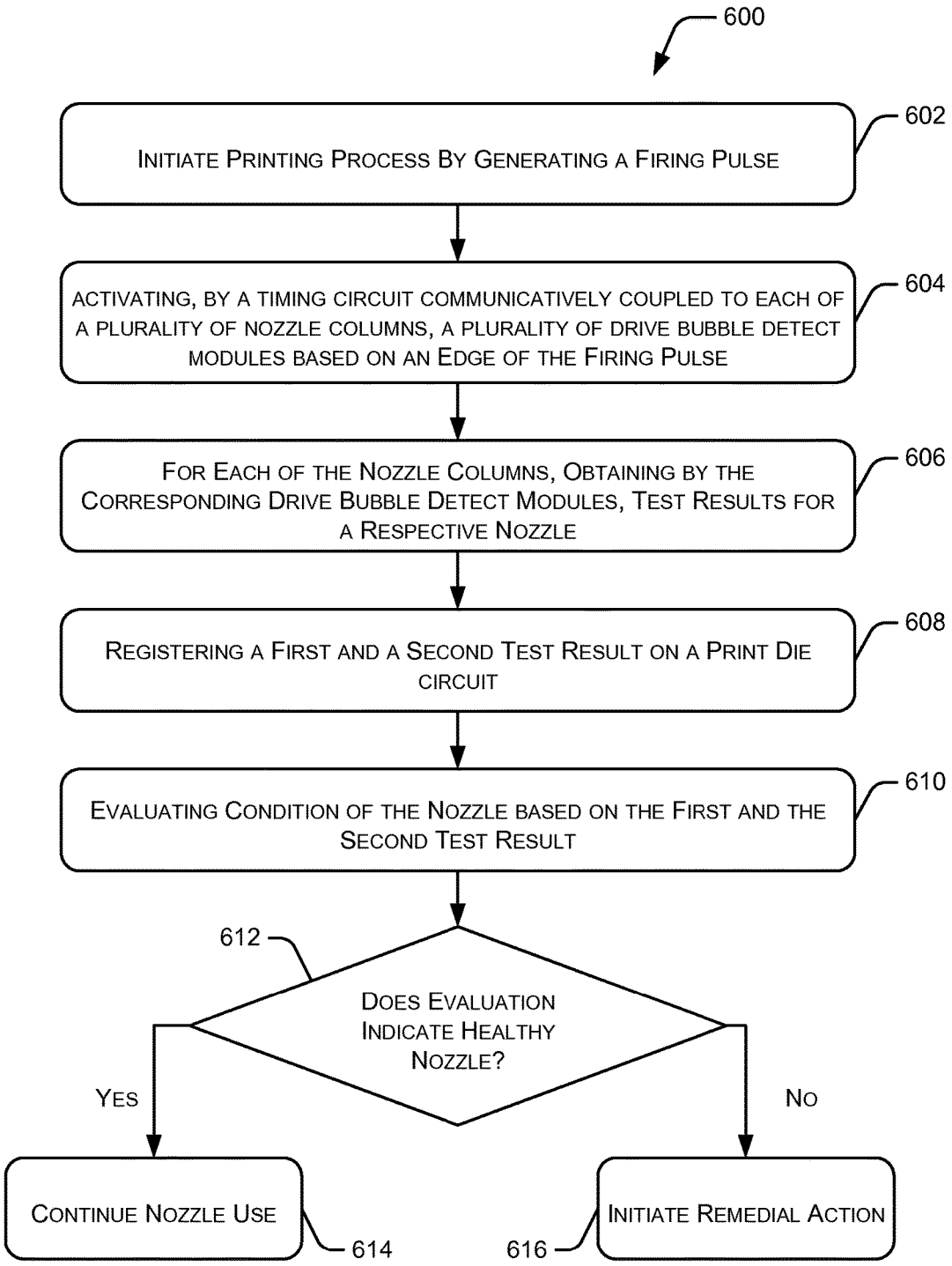
FIG. 6 illustrates another method of evaluating the print head nozzle condition of the plurality of nozzle columns, according to yet another example of the present subject matter.

FIG. 6 illustrates a method 600 for evaluating the condition of a print head nozzle, according to another example of the present subject matter. The order in which the method 600 is described is not intended to be construed as a limitation, and any number of the described method blocks may be combined in any order to implement the method 600, or an alternative method.

Further, although the method 600 for evaluating the condition of a print head nozzle may be implemented in a variety of logical circuit; in an example described in FIG. 6, the method 600 is explained in context of the aforementioned circuit 400.

At block 602, printing process is initiated by generating a firing pulse. For example, on receiving a firing pulse 302, a heating element 202 within each of the nozzles 102 activated by the firing pulse 302 starts heating the ink. A drive bubble 206 is formed, which over a period of time, envelops the sensor 116.

At block 604, a plurality of drive bubble detect modules are activated by a timing circuit 108 coupled to each of a plurality of nozzle columns based on an edge of the firing pulse. Each of the plurality of nozzle columns comprises a set of nozzles. Further, a drive bubble detect module from among the plurality of drive bubble detect modules is coupled to a corresponding nozzle column from among the plurality of nozzle columns. For example, the timing circuit 108 may activate the plurality of drive bubble detect modules 106 coupled to the corresponding nozzle columns 104 having the set of nozzles 102. Further, the drive bubble detect modules are activated upon occurrence of at least a first predetermined time instant and a second predetermined time instant. In such a case, the timing circuit 108 may measure the time that has elapsed from the occurrence of the firing pulse 302.

At block 606, for each of the nozzle columns, test results for a respective nozzle are obtained by the corresponding drive bubble detect modules. In one example, electrical impedance associated with the nozzle is determined and its corresponding impedance is compared with a threshold impedance, at the first predetermined time instant and the second predetermined time instant, based on which the test results, say, first test result and a second test result are obtained.

At block 608, a first and a second test results are registered, i.e., stored on a print die circuit. For example, the timing circuit 108 may activate the drive bubble detect module 106 to register, i.e., store the first test result 110 and the second test result 112. In one example, the first test result 110, i.e., the ink_out test result and the second test result 112, i.e., the ink_in test result are stored within the registers of the drive bubble detect module 106. In another example, the registers for storing the ink_out test result and the ink_in test result are implemented using D-type flip flops.

At block 610, based on the combination of the test results, the print head nozzle condition of the nozzle is evaluated. For example, both the first test result 110 and the second test result 112 are considered for evaluating the condition of the nozzle 102.

At block 612, it is determined whether the condition of the print head nozzle is healthy or not. For example, if the first test result 110 and the second test result 112 are good, the condition of the nozzle 102 is considered to be good ('Yes' path from block 612). In such case, the nozzle 102 may be used subsequently (block 614). If in case it is determined that the either of the first test result 110 and the second test result 112 is not good ('No' path from block 612), the condition of the nozzle 102 is categorized as not good. Subsequently appropriate actions may be taken to either replace or repair the nozzle 102 under consideration (block 616).

Although examples for the present subject matter have been described in language specific to structural features and/or methods, it is to be understood that the appended claims are not necessarily limited to the specific features or methods described. Rather, the specific features and methods are disclosed as examples of the present subject matter.

We claim:

1. A method for evaluating a print head nozzle condition of a plurality of nozzle columns on a print die, wherein each of the plurality of nozzle columns comprises a respective set of nozzles, the method comprising:

obtaining a first time instant stored in a first time repository on the print die, and a second time instant stored in a second time repository on the print die;

activating, by a timing circuit on the print die and coupled to each of the plurality of nozzle columns, a plurality of drive bubble detect modules on the print die at the first time instant and the second time instant, wherein each of the plurality of drive bubble detect modules is coupled to a corresponding nozzle column from among the plurality of nozzle columns;

for each of the plurality of nozzle columns, registering by the corresponding drive bubble detect module, test results for a nozzle of the nozzle column in memory elements on the print die, wherein the test results are based on impedances measured across the nozzle at the first time instant and the second time instant; and evaluating the print head nozzle condition of the nozzle based on the test results.

2. The method as claimed in claim 1, wherein the test results include a first test result and a second test result, and wherein the first test result is obtained by comparing impedance corresponding to the impedance measured at the first time instant with a threshold impedance.

3. The method as claimed in claim 2, wherein the second test result is obtained by comparing impedance corresponding to the impedance measured at the second time instant with the threshold impedance.

4. The method as claimed in claim 2, wherein the first test result and the second test result are in the form of a logical output.

5. The method as claimed in claim 2, wherein:

the first test result is indicative of whether a drive bubble persisted at the first time instant; and the second test result is indicative of whether the drive bubble collapsed and ink within an ink chamber associated with the nozzle replenished by the second time instant.

6. The method as claimed in claim 1, wherein the first time instant and the second time instant are measured with respect to a firing pulse based on clocked signal.

7. The method as claimed in claim 1, wherein the first time instant stored in the first time repository represents a time at which a printing fluid flows out of the nozzle, and the second time instant stored in the second time repository represents a time at which a printing fluid flows into the nozzle.

8. The method as claimed in claim 6, wherein the measuring of the first time instant and the second time instant with respect to the firing pulse comprises:

using a counter clocked by the clocked signal to measure an elapsed time from the firing pulse to the first time instant;

registering a first test result of the test results in a first memory element of the memory elements in response to the counter indicating the elapsed time from the firing pulse to the first time instant;

using the counter clocked by the clocked signal to measure an elapsed time from the first time instant to the second time instant; and registering a second test result of the test results in a second memory element of the memory elements in response to the counter indicating the elapsed time from the first time instant to the second time instant.

9. A print die comprising:

a plurality of nozzle columns on the print die, wherein each of the plurality of nozzle columns comprises a respective set of nozzles;

a first time repository on the print die to store a first time instant, and a second time repository on the print die to store a second time instant;

a plurality of drive bubble detect modules provided onto the print die, wherein each of the plurality of drive bubble detect modules is coupled to each of the set of nozzles of a corresponding nozzle column from among the plurality of nozzle columns, wherein each of the drive bubble detect modules is to:

register, for a nozzle of the corresponding set of nozzles at the first time instant obtained from the first time repository, a first test result obtained based on an impedance measured across the nozzle;

register, for the nozzle at the second time instant obtained from the second time repository, a second test result obtained based on an impedance measured across the nozzle; and determine a nozzle condition of the nozzle based on the first test result and the second test result; and a timing circuit on the print die and coupled to each of the plurality of drive bubble detect modules, wherein the timing circuit is to activate the plurality of drive bubble detect modules at the first time instant and the second time instant, to register the first test result and the second test result.

10. The print die as claimed in claim 9, wherein each of the plurality of drive bubble detect modules is to provide the first test result and the second test result as a binary output.

11. The print die as claimed in claim 10, wherein each of the plurality of drive bubble detect modules is to determine that the nozzle is functioning properly when the first test result is a logical high output and the second test result is a logical low output.

12. The print die as claimed in claim 9, wherein each of the plurality of drive bubble detect modules further comprises a memory element for registering the first test result and the second test result.

13. The print die as claimed in claim 9, wherein the timing circuit is to measure the first time instant and the second time instant with respect to an occurrence of a firing pulse.

14. The print die as claimed in claim 9, wherein the timing circuit further comprises a multiplexer for selecting one of the first time repository and the second time repository.

15. The print die as claimed in claim 9, wherein the first time instant stored in the first time repository represents a time at which a printing fluid flows out of the nozzle, and the second time instant stored in the second time repository represents a time at which a printing fluid flows into the nozzle.

16. The print die as claimed in claim 13, wherein the timing circuit comprises:

a counter clocked by a clocked signal to:

measure an elapsed time from the firing pulse to the first time instant, and measure an elapsed time from the first time instant to the second time instant, the timing circuit to cause each of the drive bubble detect modules to:

register the first test result in a first memory element on the print die in response to the counter indicating the elapsed time from the firing pulse to the first time instant;

register the second test result in a second memory element on the print die in response to the counter indicating the elapsed time from the first time instant to the second time instant.

17. A print die comprising:

a plurality of nozzle columns on the print die, wherein each of the plurality of nozzle columns comprises a set of nozzles;

a plurality of drive bubble detect modules on the print die, wherein each of the plurality of drive bubble detect modules is coupled to the set of nozzles of a corresponding nozzle column from among the plurality of nozzle columns, wherein each of the plurality of drive bubble detect modules is to:

register, for a nozzle from among the set of nozzles of the corresponding nozzle column, a first test result in a first memory element on the print die, based on comparing a first measure of impedance associated with the nozzle at a first predetermined time instant;

register a second test result in a second memory element on the print die, based on comparing a second measure of impedance associated with the nozzle at a second time instant; and determine a condition of the nozzle based on the first test result and the second test result; and a timing circuit on the print die and coupled to each of the plurality of drive bubble detect modules, wherein the timing circuit is to activate the plurality of drive bubble detect modules, at the first predetermined time instant and the second predetermined time instant, to register the first test result and the second test result.

18. The print die as claimed in claim 17, wherein the timing circuit is to measure the first predetermined time instant and the second predetermined time instant based on a number of clock cycles with respect to a firing pulse.

* * * * *